United States Patent [19]

Yasuda et al.

[11] Patent Number: 4,622,493

[45] Date of Patent: Nov. 11, 1986

[54] HIGH INTENSITY ULTRAVIOLET LIGHT SOURCE

[75] Inventors: Makoto Yasuda; Seiichi Murayama, both of Kokubunji, Japan

[73] Assignee: Hitachi, Ltd., Tokyo, Japan

[21] Appl. No.: 477,620

[22] Filed: Mar. 22, 1983

[30] Foreign Application Priority Data

Apr. 7, 1982 [JP] Japan ..... 57-56606

[51] Int. Cl.[4] ..... H01J 61/20

[52] U.S. Cl. ..... 313/642

[58] Field of Search ..... 313/642, 639, 638, 571, 313/627

[56] References Cited

U.S. PATENT DOCUMENTS 2,697,183 12/1954 Neunhoeffer ..... 313/627 X
3,720,855 3/1973 Gardner et al. ..... 313/571
3,867,665 2/1975 Furmidge et al. ..... 313/642 X

FOREIGN PATENT DOCUMENTS 45391 4/1977 Japan .

*Primary Examiner*—Palmer C. DeMeo
*Attorney, Agent, or Firm*—Antonelli, Terry & Wands

[57] ABSTRACT

A high intensity ultraviolet light-source comprises an arc tube having a pair of electrodes, filled with certain amounts of mercury, tantalum halide and rare gas, and provided with a tube loading of at least 13 Watt/cm$^2$.

9 Claims, 4 Drawing Figures

HIGH INTENSITY ULTRAVIOLET LIGHT SOURCE

BACKGROUND OF THE INVENTION

The present invention relates to an improved metal halide lamp of the type filling metal halide within an arc tube, and more particularly, to a high radiance ultraviolet light-source with enhanced wavelength range and intensity in the ultraviolet range used in apparatus for physics and chemistry.

One of the most widely used ultraviolet light-sources in an apparatus for physics and chemistry is the deuterium lamp. Apparatus for physics and chemistry have detection limit which depends on the radiance of the light-source. Recent demands in ultra-fine analysis require ultraviolet light-sources having high radiance. In order to meet such requirements, there has been proposed, as a high radiance ultraviolet light-source in place of the deuterium lamp, a metal halide lamp filled with tantalum halide as disclosed in Japanese Patent Laid-open No. 52-45391 laid open on Apr. 9, 1977. This lamp has a continuum spectrum in wavelengths ranging 220–450 nm, but has a low radiance in shorter wavelengths below 245 nm, and it cannot be used for the measurement in shorter wavelengths below 245 nm. For example, when a spectrophotometer is used for measuring sugar or organic acid which do not absorb the light in the near ultraviolet range, they need to be measured in wavelengths around 210 nm or shorter where the above tantalum halide lamp cannot be used.

SUMMARY OF THE INVENTION

Accordingly, it is an object of the present invention to provide an ultraviolet light-source having high radiance in the wide ultraviolet range.

In order to achieve the above-mentioned object, the basic feature of the present invention resides in a high intensity ultraviolet light-source having a pair of electrodes and filled with certain amounts of mercury, tantalum halides and rare gases within the arc tube, where the arc tube is provided with a tube loading of at least 13 Watt/cm$^2$.

The foregoing arrangement causes the efficient radiation from molecules of mercury with wavelengths around 190–245 nm, and consequently, an ultraviolet light-source having high radiance over a wide range of wavelength covering 190–450 nm is made feasible.

DESCRIPTION OF THE PREFERRED EMBODIMENT

The principle of the present invention will be described first. In the description, the term "tube loading" is defined as a total power of discharge divided by the inner surface area of the arc tube neighbouring the discharge. For a cylindrical arc tube, the tube loading is defined as $P/2\pi R$, where P is power in Watt/cm for the unit length of discharge between electrodes and R is the radius in cm inside of the arc tube.

Figure 1:
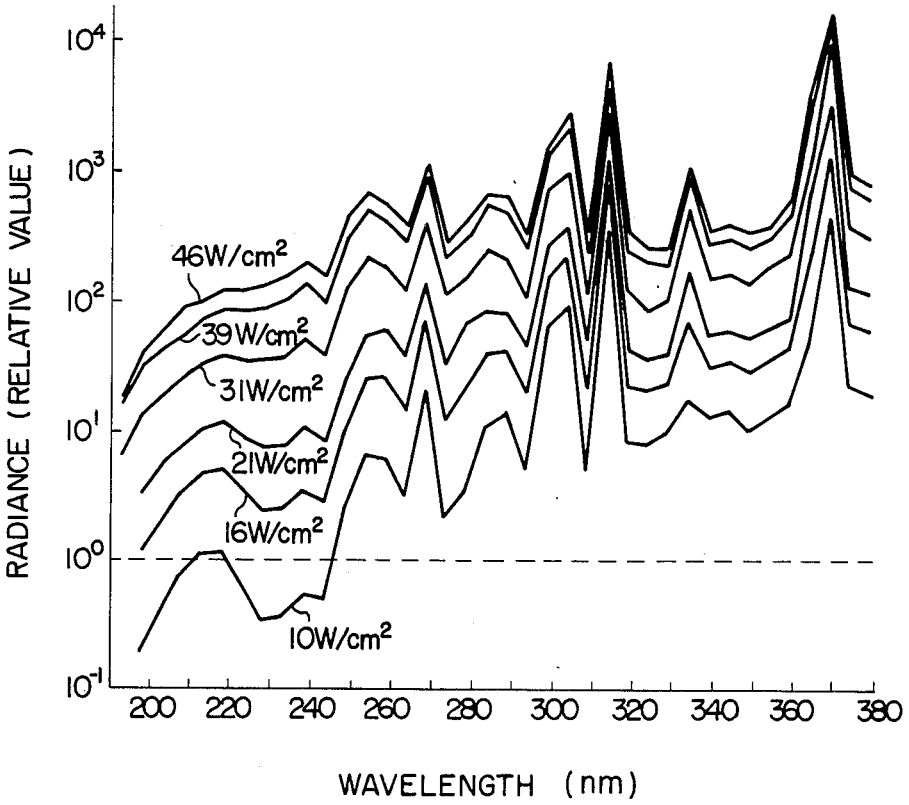
FIG. 1 is a graph showing the relative radiance vs. the wavelength relationship for various tube loadings as a parameter according to the high intensity ultraviolet light-source.
Figure 2:
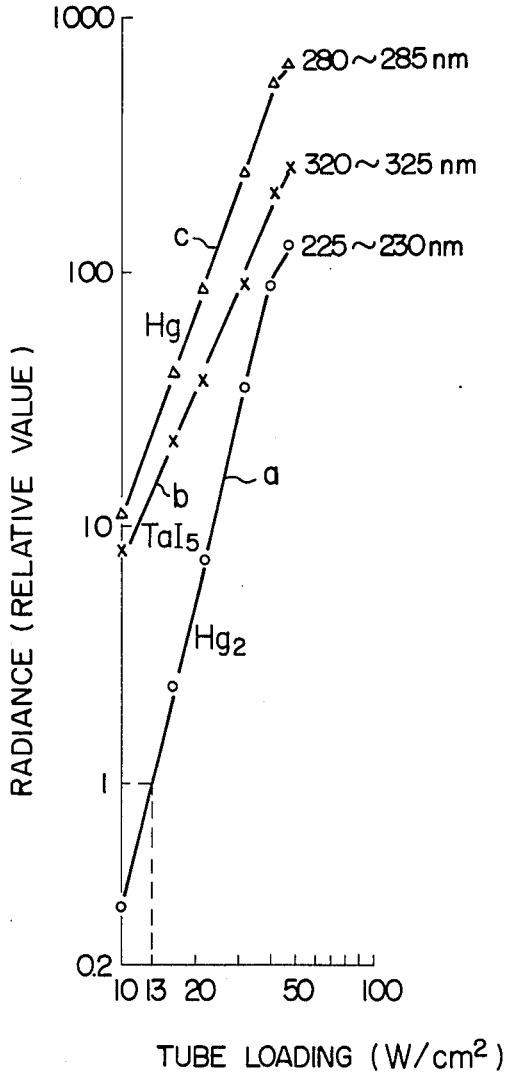
FIG. 2 is a graph showing the relative radiance of the radiation from molecules and atoms vs. the tube loading relationship according to the high intensity ultraviolet light-source.

In the metal halide lamp, it is a general convention to add mercury to components filled in the tube in order to gain the radiation efficiency or to obtain the desired electrical characteristics. The inventors of the present invention have manufactured a metal halide lamp having two tungsten main electrodes and filled with $TaI_5$ by 2 mg/cm$^3$, Hg by 6 mg/cm$^3$ and Ar by 25 Torr. FIG. 1 shows the result of measurements for the radiance of the lamp. In the graph of FIG. 1, the relative values of radiance for each wavelength with the radiance of the conventional deuterium lamp being set to 1 are plotted on the ordinate for various tube loadings as a parameter. The spectra for wavelengths of above 245 nm are formed by superimposing of the radiation from atoms of Hg on the radiation from molecules of $TaI_5$, and they provide a sufficient radiance. Whereas, the continuum spectra for wavelengths below 245 nm are formed by the radiation from molecules of $Hg_2$. It was found that by increasing the tube loading (W/cm$^2$), the radiation from molecules of $Hg_2$ can have a sufficiently effective radiance as shown in FIG. 1. That is, the radiation from molecules of $Hg_2$ increases significantly as the tube loading increases. This property is shown in FIG. 2, where a curve a shows the radiance of radiation from molecules of $Hg_2$ for the range 225–230 nm, a curve b shows the radiance of radiation from molecules of $TaI_5$ for the range 320–325 nm and a curve c shows the radiance of radiation mainly from atoms of Hg for the range 280–285 nm, each relative to the radiance of the deuterium lamp. It can be seen from FIG. 2 that the radiation from $Hg_2$ molecules (curve a) increases sharply as the tube loading increases as compared with the radiation from $TaI_5$ molecules (curve b) and the radiation from Hg atoms (curve c). On this account, the most significant factor for obtaining a light-source having a continuum spectrum with sufficiently high intensity in the wavelength range above 190 nm is the determination of the value of tube loading. In order for a light-source to have a higher radiance than that of the conventional deuterium lamp, the lamp needs to have a higher radiance in the wavelength range 225–230 nm than that of the deuterium lamp. This condition is satisfied by setting the tube loading to 13 W/cm$^2$ or more, as can be seen from FIG. 2.

Figure 3:
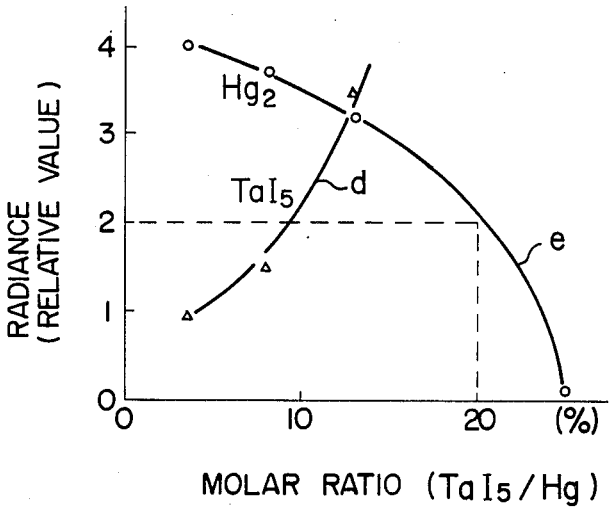
FIG. 3 is a graph showing the relative radiance of the radiation from molecules vs. the molar ratio relationship according to the present invention.

Further experiments in high intensity ultraviolet light-sources with tube loadings of 13 W/cm$^2$ or more led to the following facts. The radiation from molecules of tantalum halide can be enhanced by increasing the ratio of the quantity of tantalum halide and the quantity of mercury filled in the tube. However, this causes a fall in the temperature of discharge plasma, resulting conversely in a weaker radiation from molecules of $Hg_2$ on the spectrum below 245 nm. Several lamps filled with $TaI_5$, Hg and Ar by 25 Torr. were manufactured, and their radiance from molecules of $TaI_5$ and $Hg_2$ were measured for lamps with various molar ratio of $TaI_5$ to Hg. FIG. 3 shows the result of the measurement, where a curve d shows the relative radiance from molecules of $TaI_5$ at 340 nm, and a curve e shows the relative radiance from molecules of $Hg_2$ at 220 nm with a tube loading of 46 W/cm$^2$. It can be seen from FIG. 3 that in the range of the molar ratio below 20%, the radiation from molecules of $Hg_2$ (curve e) has a sufficient radiance to realize a high intensity ultraviolet light-source with a continuum spectrum for wavelengths ranging 190–450 nm.

Further experiments led to the following facts. Tantalum halide has a high saturated vapor pressure; e.g., $TaI_5$ has a saturated vapor pressure of around 20 Torr. at 300° C. With this high saturated vapor pressure, the radiation from $TaI_5$ can be obtained sufficiently. On the other hand, the lower the temperature of the arc tube, the longer is the service life of the metal halide lamp. Accordingly, a lamp filled with tantalum halide can be a long life light source with a sufficiently high vapor pressure by maintaining the coldest point temperature below 600° C.

Figure 4:
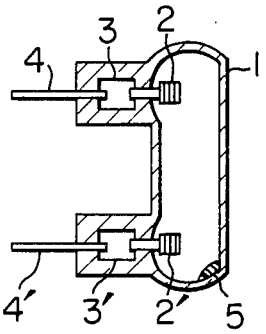
FIG. 4 is a sectional view showing the structure of the arc tube according to the high intensity ultraviolet light-source.

One embodiment of the present invention will now be described with reference to FIG. 4. In the figure, main electrodes 2 and 2' made of tungsten are sealed at two points on arc tube 1 which is formed of fused silica or the like for transmitting ultraviolet rays. The tungsten main electrodes 2 and 2' are connected through molybdenum foils 3 and 3' to lead wires 4 and 4' made of molybdenum, respectively. The arc tube 1 is filled with filler 5 and Ar gas as will be described later. In some applications, the arc tube 1 is fixed within an outer tube, at least a part of which wall transmits ultraviolet rays, so as to stabilize the discharge. In most of this case, the outer tube is evacuated to a vacuum.

The arc tube 1 is filled with $TaI_5$ by 2 mg/cm$^3$, Hg by 6 mg/cm$^3$ and Ar by 25 Torr. $TaI_5$ may be filled in such a way that metal Ta and $HgI_2$ are filled in the tube 1 so that they will react to become $TaI_5$. The arc tube 1 was supplied with power with a tube loading of 13 Watt/cm$^2$ or more, and a high intensity ultraviolet light-source providing a sufficient high radiance for wavelengths ranging 190–450 nm could be achieved.

It will be appreciated that an auxiliary electrode may be added to the main electrodes 2 and 2' for easy start of discharging or other purposes.

According to the present invention, as described above, an ultraviolet light-source with high intensity for the wide ultraviolet range can be realized, which can be used for much universal-type apparatus for physics and chemistry, allowing high sensitivity analysis. In addition, the high intensity ultraviolet light-source according to the present invention has a longer service life as compared with the deuterium lamp, and it is also advantageous economically.

What is claimed is:

1. A high intensity ultraviolet light-source comprising mercury, tantalum halide and rare gas filled in an arc tube having a pair of main electrodes, wherein the quantity of said tantalum halide filled in said arc tube is less than or equal to 20% in molar ratio with respect to the quantity of mercury, said mercury and said tantalum halide radiating ultraviolet rays to thereby provide the ultraviolet light, and wherein said light-source has a tube loading of at least 13 Watt/cm$^2$, to thereby provide a light-source having a sufficiently high radiance at wavelengths of at least 190–245 nm for said light-source to be a source of light at wavelengths of 190–450 nm, including said at least 190–245 nm.

2. A high intensity ultraviolet light-source according to claim 1, wherein the arc tube contains sufficient amounts of mercury and tantalum halide such that the light-source is a high intensity light-source with a continuous spectrum for wavelengths ranging from 190–450 nm.

3. A high intensity ultraviolet light-source according to claim 1, wherein said tube has a coldest point which is maintained below 600° C.

4. A high intensity ultraviolet light-source radiating ultraviolet radiation, comprising:

mercury, tantalum halide and rare gas filled within an arc tube having a pair of main electrodes, the ultraviolet radiation radiating from both molecules of mercury and tantalum halide, wherein the quantity of the tantalum halide filled in said arc tube is less than or equal to 20% in molar ratio with respect to the quantity of mercury, and wherein said arc tube is provided with a tube loading of at least 13 Watt/cm$^2$.

5. A high intensity ultraviolet light-source according to claim 4 wherein said arc tube has a coldest point which is maintained below 600° C.

6. A high intensity ultraviolet light-source according to claim 4, wherein the arc tube contains sufficient amounts of mercury and tantalum halide such that the light-source is a high intensity light-source with a continuous spectrum for wavelengths ranging from 190–450 nm.

7. A high intensity ultraviolet light-source for radiating ultraviolet radiation over a continuous spectrum of wavelengths ranging from 190–450 nm, comprising:

mercury, tantalum halide and rare gas filled within an arc tube having a pair of main electrodes, the ultraviolet radiation radiating from both mercury and tantalum halide molecules to provide said radiation over said continuous spectrum, wherein the quantity of tantalum halide filled in said arc tube is less than or equal to 20% in molar ratio with respect to the quantity of mercury, and wherein said arc tube is provided with a tube loading of at least 13 Watt/cm$^2$, to thereby provide a light-source having a sufficiently high radiance at wavelengths of at least 190–245 nm such that the light-source can be a source of light at wavelengths of 190–450 nm, such high radiance at wavelengths of at least 190–245 nm being achieved due to the sharp increase in radiance of $Hg_2$ as the tube loading increases and due to said quantity of tantalum halide being less than or equal to 20% in molar ratio with respect to the quantity of mercury.

8. A high intensity ultraviolet light-source according to claim 7, wherein the tantalum halide is $TaI_5$.

9. A high intensity ultraviolet light-source according to claim 7, wherein said tube has a coldest point which is maintained below 600° C.

* * * * *